US005358443A

United States Patent [19]

Mitchell et al.

[11] Patent Number: 5,358,443

[45] Date of Patent: Oct. 25, 1994

[54] DUAL FAN HEPA FILTRATION SYSTEM

[75] Inventors: Robert G. Mitchell, Westfield; George Havrilla, Sumerville, both of N.J.

[73] Assignee: CenterCore, Inc., Wayne, Pa.

[21] Appl. No.: 47,597

[22] Filed: Apr. 14, 1993

[51] Int. Cl.[5] ..... F24F 7/007

[52] U.S. Cl. ..... 454/230; 55/473; 55/502

[58] Field of Search ..... 55/487, 470, 473, 498, 55/502, 521; 454/230, 231, 233, 310

[56] References Cited

U.S. PATENT DOCUMENTS 3,850,598 11/1974 Boehm ..... 454/230 X 5,288,267 2/1994 Mitchell ..... 454/230

FOREIGN PATENT DOCUMENTS 527299 6/1931 Fed. Rep. of Germany ..... 454/310

*Primary Examiner*—Harold Joyce

*Attorney, Agent, or Firm*—Eugene E. Renz, Jr.

[57] ABSTRACT

A device for use with at least one workspace, to produce an umbrella of clean room air for a distance of one meter from the device and 98% fewer particles than the air in the area three meters from the device. The device has a chamber defined by an outer wall, end walls and a filter as the inner wall. The filter functions as tile sole outlet of air. A motor with an axially extending drive shaft is mounted inside said filter. The shaft has an intake fan mounted on one end to define a sealed path which is the sole air inlet to the chamber. An exhaust fan is mounted on the other end of the shaft to define a path from the sole outlet. Air is exhausted in an axial direction is then deflected from the axial direction to the radial direction onto a baffle to reduce the velocity of the air to laminar flow. The baffle includes an upper terminal lid and a plurality of annular stepped vanes that divide the axially exhausted air into turbulent air streams and converts the turbulent air streams into radial laminar flow.

14 Claims, 7 Drawing Sheets

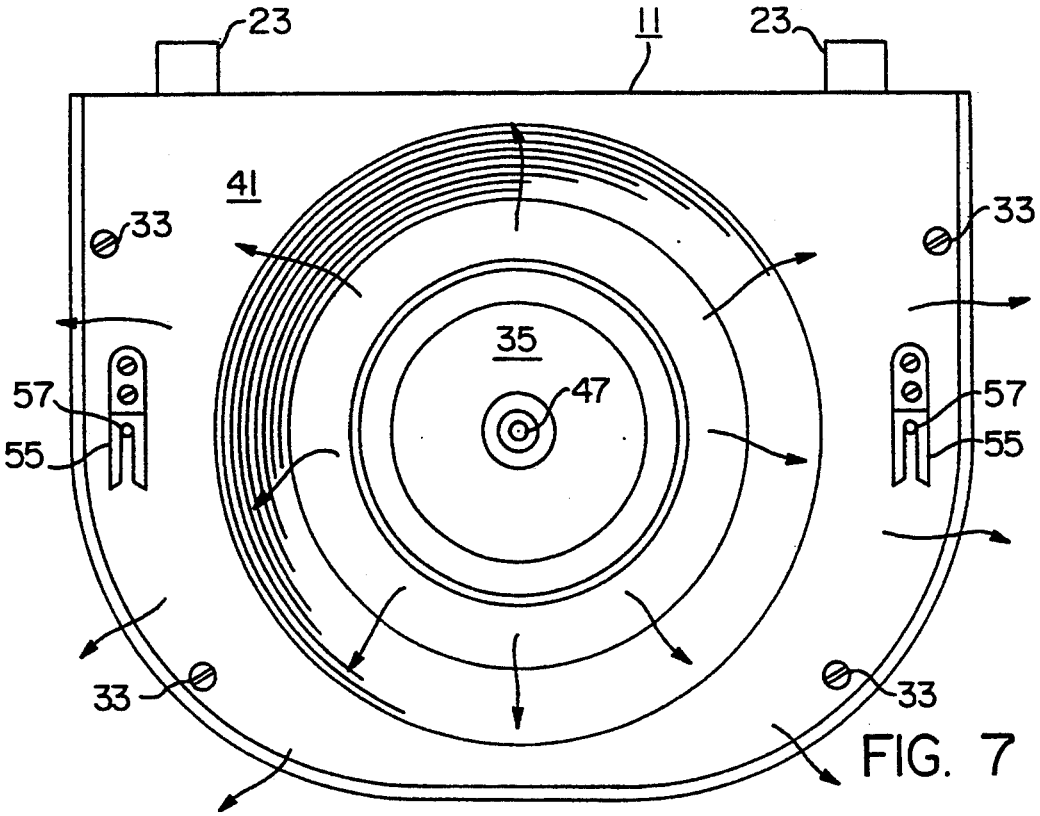
FIG. 7
FIG. 8
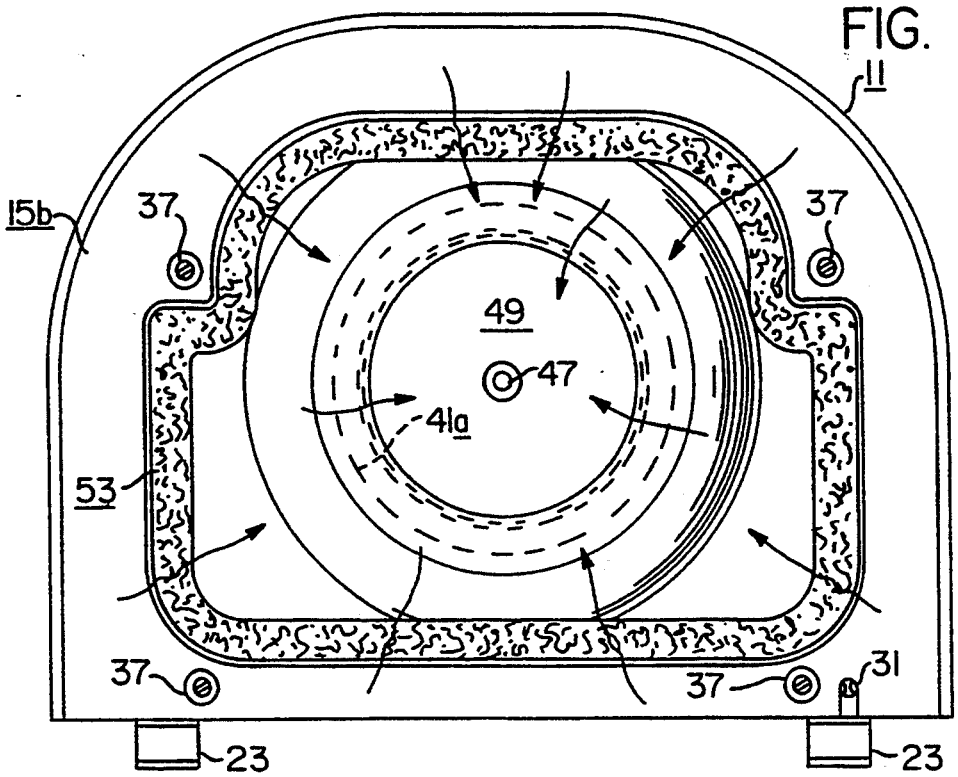

DUAL FAN HEPA FILTRATION SYSTEM

FIELD OF THE INVENTION

The present invention relates to an improved air circulation system for workspace units, and more particularly to a work space device which substantially improves the quality of air at the workspace without significant modification of the work station.

BACKGROUND OF THE INVENTION

The modern office utilizes space in many more effective ways than in the past. Although roll top desks are attractive and have interesting character, modern desks and workspaces are much more efficient. Cost of manufacturing workspaces is also more important as profit margins are squeezed and an improvements in worker efficiency is needed. Workspaces are now designed for individuals working alone and also for groups of workers who share part of a room. Cluster workspaces are being used where related tasks are being performed by several employees.

In order to increase the efficiency of space utilization at workspaces, cluster workspaces have been developed which use common partitions to divide an area into three, four or more individual work stations. Each station is personalized with specific, needed office equipment, such as word processors, computers, postal meters, and the like. In many cases, there is at least one person who experiences heat or cold to a greater or lesser extend than the other workers. Also, many times there are persons using the work stations who are allergic to smoke, dust, pollen and the like. These persons and all who work at work stations deserve and should have an appropriately clean and healthy environment in which to work.

U.S. Pat. No. 4,625,633 in the name of Martin, is a commonly owned patent which describes a ventilated core unit for service connections useful in work station arrays. Various prior art patents are disclosed the Martin Patent. The disclosure of all of those patents may be summarized by a statement in the Martin Patent that none of the prior art discloses the benefits of an independently controlled zone unit that is not attached to building HVAC equipment by air ducts.

Martin correctly identifies a modern trend in office furniture and layout arrangements in which small semi-private working cubicles are created a central core with multiple work stations and equipment emitting from that core. The Martin design has been very successful in providing a central core unit which accomplishes both ventilating and utility connections for peripheral work spaces.

The principal basis upon which the Martin invention is founded is the use of a central core unit for local ventilating, where the core unit also provides utility connections to peripheral work spaces around the core. A work space fan is mounted in a side wall of the cabinet. That fan is operable under user control to draw air from the work space into the plenum defined by the walls of the cabinet. The air is then discharged to the common area directly above the work space.

No system is perfect, however, and several drawbacks have been encountered in the use of the Martin system. Most of these drawbacks have been solved by the air circulation system described in commonly owned Mitchell et al U.S. Pat. No. 5,065,668. For the first time, it has been possible to obtain a class 100,000 rating for an office space, which is highly desirable for health reasons as well as for insurance ratings. The system includes the construction of a core having an inlet which draws an ambient air and an outlet which exhausts air such that the air flow combines with the side walls of a work station to enclose an individual using the work station in an envelope of processed air. Many newly installed work spaces have taken advantage of the Mitchell et al air circulation system to produce a plurality of work stations of optimum air quality and at the same time improve air quality in the entire room.

The Mitchell et al system requires the construction of a central core of at least sufficient size to process the air through the inlet and outlet. New construction of work stations is greatly improved by the Mitchell et al design, giving a better alignment of work space for a given quantity of available space. However, many work stations presently exist and would be suitable for continued use if the quality of the environment surrounding the work station could be improved. These existing work stations typically converge upon a central point rather than on a central core. These existing work stations may be visualized as being two or more walls which intersect each other to define work stations which are separated by a portion of each wall.

Another factor which has become significant in the design of office modules of the type described above is the need for controlling the noise in the environment directly adjacent to the worker. In the past it has been possible to 'drown' out distracting noise by the use of a radio or other source of music. However, the distractions from that alternative are also a problem for those interested in maximizing efficiency while also providing the most appropriate work station. Systems which provide fresh air often times provide air at a velocity which blows papers around or otherwise distracts those working at the table or desk. Sometimes the noise is just too great and the worker seeks peace by turning off the fan, thereby giving up the advantage of fresh or purified air.

At the present time there is no effective answer to the needs of those who would seek to provide purified, fresh air in an already existing work station environment. One of the major problems is the need to filter air, such as by using the HEPA filter used in the above referenced Mitchell et al system, without creating such a large unit that it dominates the work station. Mitchell et al accomplishes effective space utilization by using the central core about which the work station is built, which as mentioned is effective for new construction.

To provide a motor capable of 150 to 300 cubic feet per minute (CFM) of air flow as does Mitchell et al is not practical for existing systems for two reasons. First, the size of the motor would be excessive. Second, the noise generated by the motor and fan ducts would also be excessive. Accordingly it would be of great advantage in the art if a design could be provided which is capable of moving a desired quantity of air though a HEPA filter at the appropriate CFM rate of flow while maintaining minimal noise levels, operating cost efficiencies, and cabinet or enclosure size parameters.

It is therefore an object of this invention to provide a device which will significantly improve the environment of these work stations without requiring major modification or replacement of existing walls.

Another object of the present invention is to provide an air circulation system which is effective in removing particulates from the air proximate the work station.

Still another object of this invention is to provide air circulation that is effectively sized and yet is quiet and does not disturb the worker or other persons in the immediate environment.

Other objects will appear hereinafter.

SUMMARY OF THE INVENTION

It has now been discovered that the above and other objects of the present invention may be accomplished in the following manner. Specifically, the present invention provides a device for use with at least one workspace to produce a flow of laminar air which is exhausted in an umbrella of clean room air for a distance of at least one meter from the device and having 98% fewer particles than the air in the area at least three meters from the device.

The device includes a chamber defined by an outer wall and end walls at the top and bottom. The chamber is completed by its inside wall which comprises a filter means which also is the sole outlet of air entering the chamber. Air must go through the filter to leave the chamber, since the outer wall and ends are sealed.

A fan motor is mounted proximate the center of the cabinet and includes a drive shaft extending axially out from motor in two directions. The fan motor serves to drive an intake fan and an exhaust fan so that air is pushed into the chamber and through the filter, and is also pulled out of the chamber through the filter. The intake fan is mounted on one end of the shaft so as to define a first sealed path which is the sole air inlet to the chamber. The first path includes a seal for preventing air flow past the shaft of the motor. In this manner, air is pushed by the intake fan into the chamber. Since the filter is the only path for the air to leave the chamber, a positive pressure on the filter is achieved to cause the filter to receive and clean the air.

An exhaust fan is mounted on the other end of shaft to define a second path leading from the filter. This second path is the sole outlet from the chamber, with the path directing the air via the exhaust fan to thereby exhaust air in the generally axial direction. Baffles are provided for deflecting air from the axial direction to the radial direction while reducing the velocity of the air to laminar flow. The baffle means include a plurality of annular stepped vanes for dividing axially exhausted air into turbulent air streams and converting the turbulent air streams into radial laminar flow. Preferably, the baffle means cooperatively employs the top lid and in combination with at least two annular stepped vanes spaced axially out from the exhaust fan and which vanes have decreasing inner radii in the axially outward direction.

Air which flows from the exhaust fan may be laminar under some conditions but it is possesses a high velocity. As the air impinges on the stepped vanes and upper lid, part of the air impinges on the closest vane, part goes past to the next vane with in inner diameter that is smaller, and so on to the upper lid. As air strikes the vane, the air flow direction is changed from substantially the axial direction to the radial direction. Due to the length of the vanes in the radial direction and their spacing, the air flow becomes laminar, at a much reduced velocity. Since the volume enclosed by the vanes is much greater than the volume of air carried at any one time by the exhaust fan, the desired rate of flow is maintained but at a much slower and therefore much quieter flow rate.

The preferred motor is rated at less than 2 amp and the device produces at least 150 CFM of exhaust air. These conditions are necessary when the filter is a HEPA filter requiring about 150 CFM for optimum filtration efficiency. Because the velocity of the exhausting air is reduced and is substantially laminar, the system produces noise proximate the device of less than 50 decibels. When the device is mounted on a divider wall of a work station, the work station is provided with clean, filtered air which is quiet and does not distract the worker.

BRIEF DESCRIPTION OF THE DRAWINGS

For a more complete understanding of the invention, reference is hereby made to the drawings, in which:

FIG. 7 is a sectional plan view taken on the line 7,7 of FIG. 6.

FIG. 8 is a bottom sectional plan view taken on the line 8,8 of FIG. 6.

DETAILED DESCRIPTION OF THE PREFERRED EMBODIMENT

Figure 1:
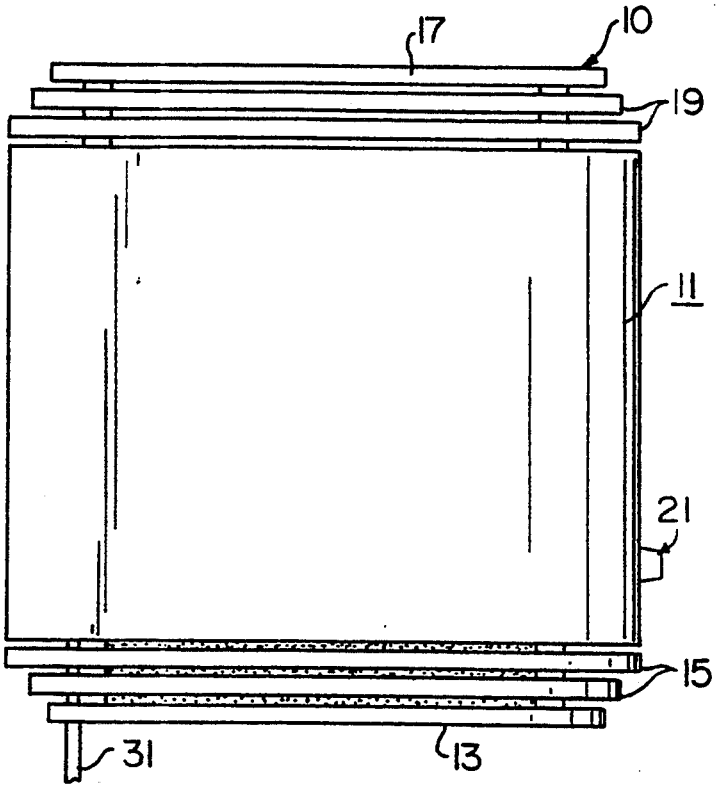
FIG. 1 is a front elevational view of a personal work station air filtration device of the present invention.
Figure 2:
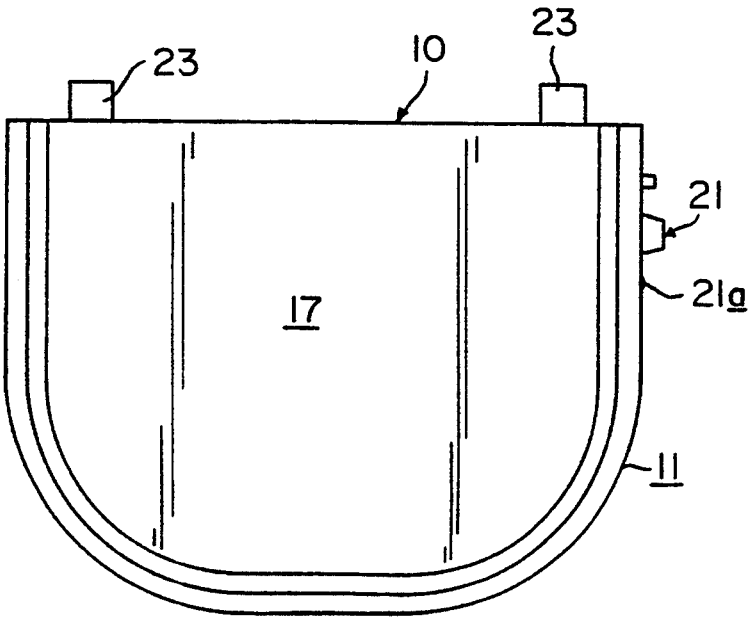
FIG. 2 is a plan view of the device shown in FIG. 1.
Figure 3:
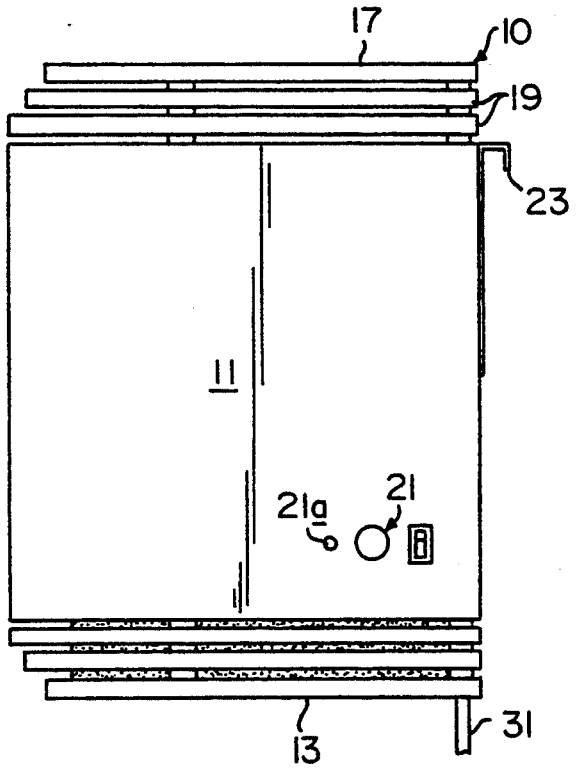
FIG. 3 is right side elevational view of the device shown in FIG. 1 and 2.

As shown in the drawings, a device 10 generally is provided which produces laminar air that is exhausted in an umbrella of clean room air for a distance of at least one meter from the device such that the air in the umbrella has 98% fewer particles than the air in the area at least three meters from the device. The device 10 is designed for use with at least one workspace of conventional design and includes an outer cabinet 11 in which the air purification takes place. As seen in FIGS. 1 and 2, the cabinet 11 is symmetrical and includes a bottom lid 13 with lower vanes 15 for air to be introduced into the cabinet 11. Also provided is a top lid 17 and a plurality of upper vanes 19 which function to direct laminar flow pure air over the workstation in a manner which is quiet and which accommodates the sensitivity of the person using the workstation. Alternatively, the device can be configured for installation in a corner, and would then have an outer shape to conform to the corner where it is to be installed. Cabinet 11 and the vanes 15 and 19 are preferably manufactured from wood or other sound deadening material. Cabinet 11 may be painted or otherwise covered with decorative material.

Figure 4:
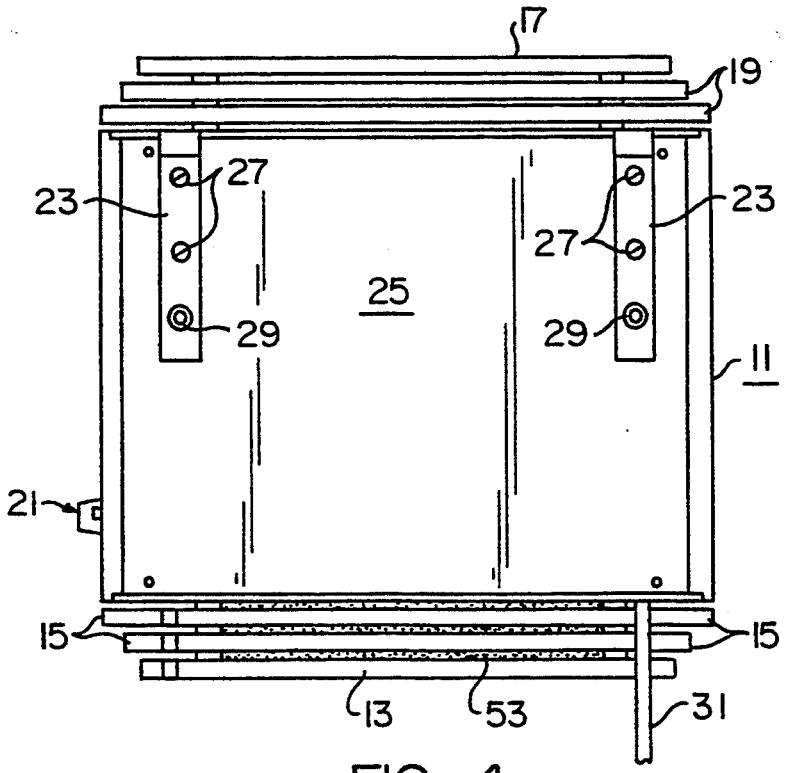
FIG. 4 is rear elevational view of the device shown in FIGS. 1, 2 and 3.

Operator controls 21 are provided which may merely serve to turn the device on and off, with an indicator light 21*a*. Alternatively, the controls 21 may allow the user to adjust the speed of air flow, within limitations of the filter as will be described. As mentioned, the device 10 is intended to be used in a work space. Any work space is suitable for the advantages of the present invention, but the invention is particularly suited for workstations in which a plurality of partitions are provided to divide an area into segments for the various workers and work functions. This embodiment of the device 10 includes two hanger brackets 23 which are fastened to the back 25 of cabinet 11. Only two screws 27 are needed to support each bracket 23 on the cabinet 11, but at least three holes 29 are provided so that the height of the device may be adjusted as needed. Power cord 31 extends down through lower vanes 15 and lower lid 13 as is shown in FIG. 4. The vanes 15 and lower lid 13 are slotted on either side of center so that cord 31 can be brought down either side of back 25.

Figure 5:
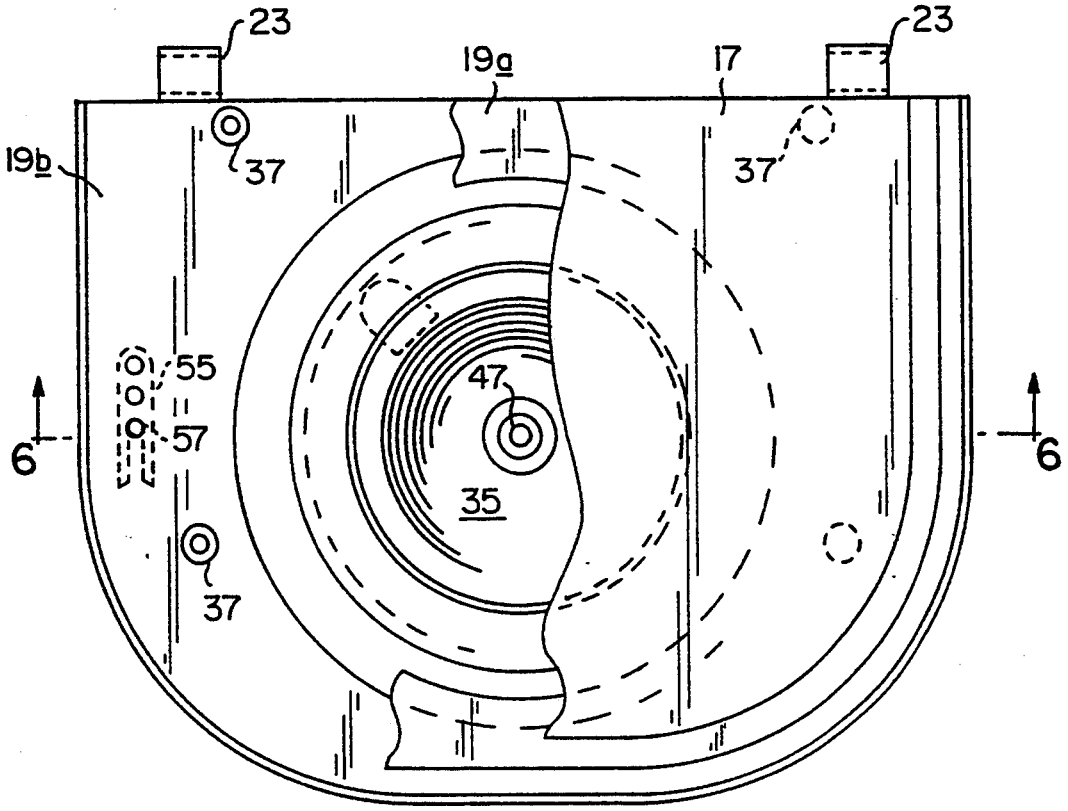
FIG. 5 is an enlarged plan view of the device shown in FIGS. 1–4, with portions broken away to show some of the interior details.
Figure 6:
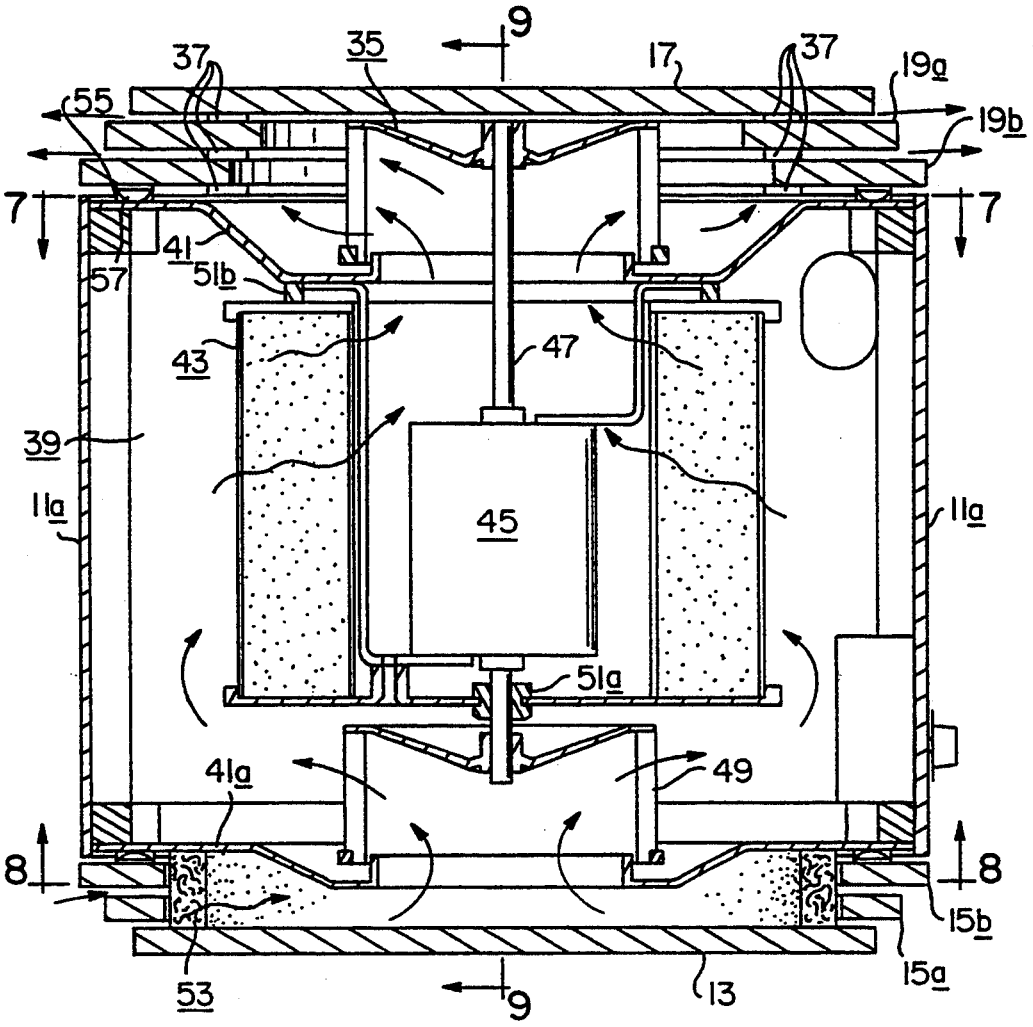
FIG. 6 is a sectional elevational view taken on the line 6,6 of FIG. 5.

Turning now to the inside of cabinet 11, FIG. 5 illustrates the device with a portion of upper lid 17 and the upper vanes 19*a* and 19*b* broken away to show some of the details of the interior. The top lid 17 and vanes 19*a* and 19*b* form an integral unit which is assembled by means of 4 screws and spaced apart vertically by spacing discs 37 which position lid 17 directly in the outlet flow of exhaust fan 35. FIG. 6 shows an arrangement of the lid 17 and vanes 19*a* and 19*b* all being spaced by spacers 37. Of primary importance to the present invention is the creation of a chamber 39 which is defined on the outside by the outer walls 11*a* of cabinet 11 and at both ends by sealed end walls 41 and 41*a* at the top and bottom of the chamber respectively.

Filter 43 defines the inner wall of chamber 39 and provides the sole outlet of air entering chamber 39. In the preferred embodiment of the present invention, the filter is a HEPA filter which is commercially available and has an efficiency of at least 99.97% at 0.3 microns, using a DOP test procedure. HEPA filters preferably operate at an optimum efficiency when the flow of air through the filter is at about 150 CFM. However, the present invention contemplates the use of other filters where appropriate. For example, a large, heavily compacted charcoal filter could be used in place of the HEPA filter to remove strong odors or heavy cigarette smoke because of the unique power, efficiency and quiet operation of the present invention. In any event, the present invention requires that the chamber defined by the outside wall and end walls have only one exit or outlet for air which enters the chamber, thus assuring that the filter will function effectively to remove the maximum amount of undesirable pollutant.

Located centrally in the cabinet 11 and inside filter 43 is motor 45. An axially aligned shaft 47 extends out of both ends of motor 45. Previously identified exhaust fan 35 is mounted on the upper end of shaft 47 while intake fan 49 is mounted on the lower end. It is intended that the air which is discharged at the work station form an umbrella of air and for this reason the exhaust is located at the top of the device, although the device will operate in other orientations if desired.

Air is drawn into chamber 39 by intake fan 49, as air flows quietly and at laminar flow between bottom lid 13, vanes 15*a* and 15*b* as shown at the bottom of FIG. 6. A sealed path is defined by the intake fan 49, the vanes 15*a* and 15*b* and bottom lid 13, along with bottom end wall 41*a* so that there is only path for air to enter chamber 39. Shaft 47 includes seals 51*a* and 51*b* to prevent any air from passing into the interior where motor 45 is located except by passage through filter 43 as previously described.

Air is pulled into intake fan 49, and may be optionally filtered by a charcoal filter 53, for example, located in the inlet path to remove odor efficiently. Air is also compressed in chamber 39 and applies a positive pressure on filter 43, so that intake fan 49 acts to push air into the system. At the same time, air is pulled through filter 43 by exhaust fan 35 so there is a dual action on the filter which is provided by two fans from one motor.

The efficiency of this arrangement is exceptional. It is now possible for the first time to provide HEPA filtered air at a single workspace without the use of a large motor pushing or pulling air through the filter, creating noise and turbulent flow which is sometimes distracting enough to cause the operator to turn off the device. Instead, with the present invention, a quiet, gentle or laminar flow of air at a moderate velocity extends out over the user to provide virtually a clean room atmosphere in the midst of an otherwise polluted room. It has been discovered that motor 45 can deliver the required 150 CFM or more with up to 40% to 60% less current rating. Specifically, it has been discovered that pure air results are achieved with the present invention with a 1.2 amp motor which is fully effective in replacing previously used 2 amp and even 3 amp motors in older designs which did not employ this invention.

Another advantage of the present invention is that it is much quieter than the old, single fan methods of filtering with a HEPA filter. Conventional units which attempt to use HEPA filters have operated, at best, at 53 to 57 decibels (db). The present invention typically operates at 40–47 db, which is a surprising and important improvement. Sound over 3 db is considered to be perceptible by persons with ordinary hearing. Db measurements in the 40's, as the present invention provides, is rated as a quiet room. A quiet room promotes effective concentration and increased efficiency. Sound over 50 db falls into the rating for room conversation. While it is not so objectionable as to be harmful to one's health, like working next to a jackhammer would be, conversation is distracting and noise over 50 db will eventually detract from the maximum utilization of the workspace.

The substantial noise reduction provided by the present invention and the surprisingly low power requirements needed to achieve 150 CFM flow of air through the HEPA filter (or heavily packed charcoal or the like) is accomplished because of the unique combination of air flow baffles at both ends of the device but particularly at the exhaust or discharge end. As is seen in the top of FIG. 6, air is pulled through filter 43 by exhaust fan 35 and is pushed axially with considerable force. Because of the shape of upper end wall 41, air is directed axially, at least in part, and thus is directed at upper lid 17.

However, the large stream of air coming from exhaust fan 35 first engages upper vane 19*b* which has a larger inner diameter than the next vane 19*a*. Accordingly, some of the air is directed into a radial direction between the outside of top end wall 41 and the bottom of vane 19*b*. Vane 19*b* is spaced from the outside of top end wall 41 to provide a gap which smoothes out the flow of air there between into laminar flow. In addition, more of the air is directed into a radial direction as it intersects vane 19*a* to flow laminarly between vanes 19*a* and 19*b*. The remaining air is then directed between the bottom of top lid 17 and the top of upper vane 19*a*, again in laminar flow. Laminar flow is established by the radial spacing of sufficient length to accomplish that result. Thus the turbulent air inside cabinet 11 is exhausted out over the workspace in a gentle, quiet, laminar flow, using much less power and producing much less noise than heretofore possible.

FIGS. 7 and 8 illustrate details of the upper closed end and lower sealed end leading into and out of chamber 39 respectively. Arrows illustrate schematically the flow of air, which flow is as mentioned both quiet and gentle or laminar. FIG. 7 also illustrates another feature of the present invention. At times it is desirable or necessary to perform repairs or cleaning on any device. In this invention, the HEPA filter may be effective for a year or even much more, depending on the particular environment of use. Eventually, it will be desirable to replace or clean the filter.

Both the top and bottom lid and vane assemblies can be removed be simply pulling the lid and vane assembly forward from the front face of cabinet 11. The fans 35 and 49, the HEPA filter 43 and motor 45 form an integral unit with upper end plate 41 that also can be withdrawn from the cabinet 11 for servicing by removal of hold down screws 33. Vanes 19*a* and 19*b*, as well as lower vanes 15*a* and 15*b*, are supported by hanging them in bifurcated spring clips 55 which accept screws 57 located in the upper surface of the vanes, such as vane 19*a*. When screw 57 is loosened, it slides out of slotted clip 55 for easy removal. Of course, once top lid 17 and upper vanes 19*a* and 19*b* are removed, motor 45 can be lifted out for servicing or maintenance. Similarly, vanes 15*a* and 15*b* are carried by similar slotted clips 55*a* with screws 57*a* to provide access to pre-filter 53 or for other maintenance or cleaning of the device.

Figure 9:
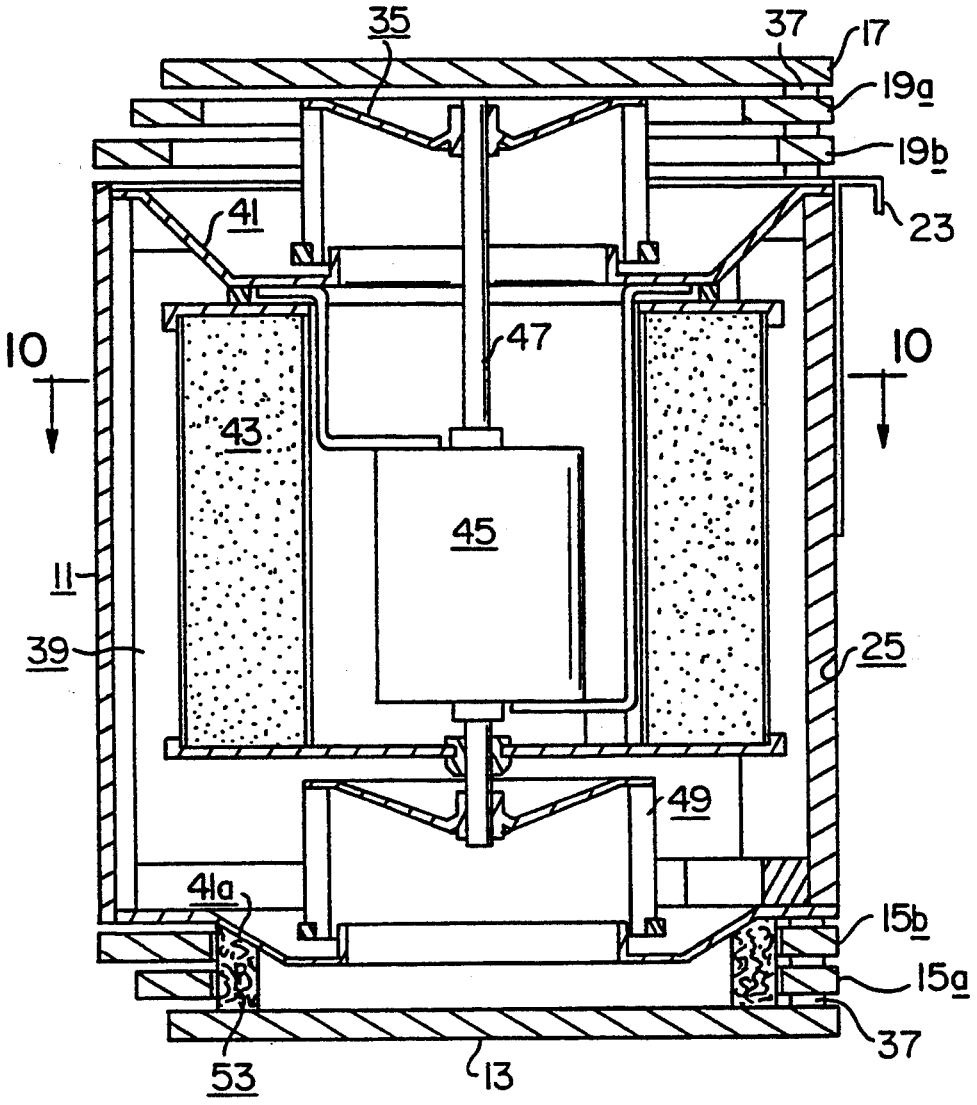
FIG. 9 is a sectional elevational view taken on the line 9,9 of FIG. 6.
Figure 10:
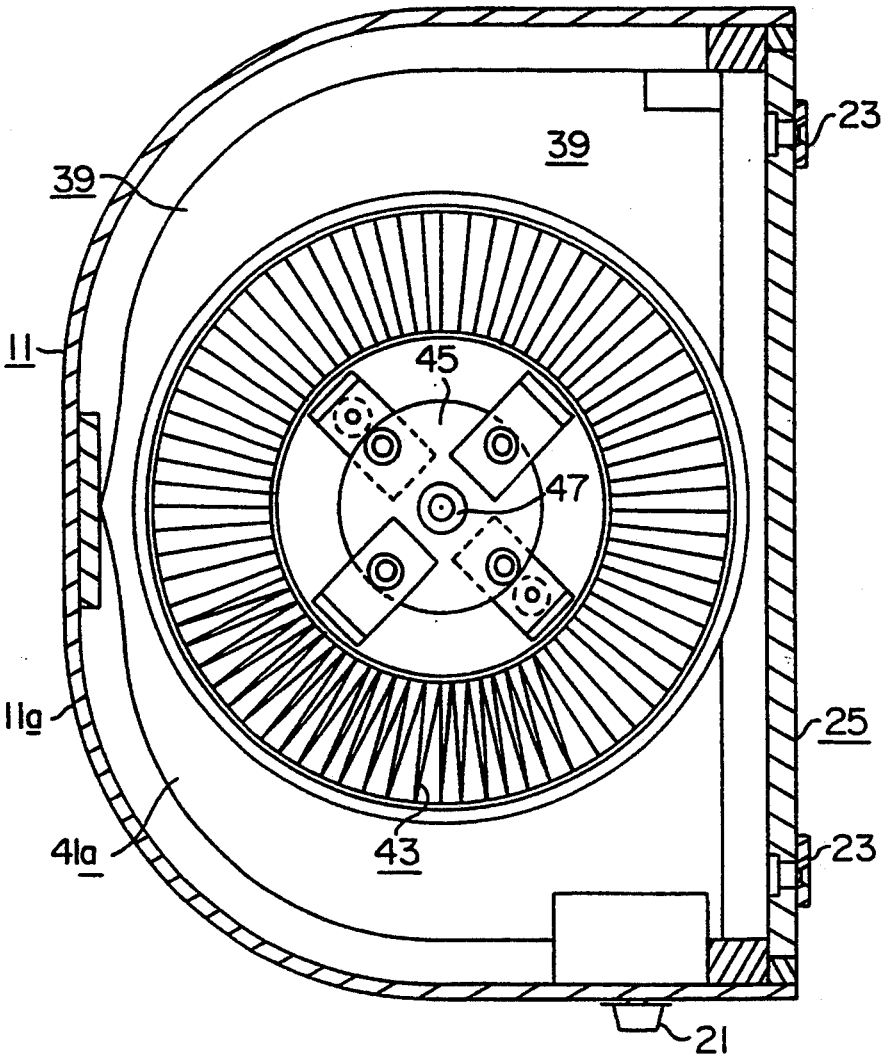
FIG. 10 is a sectional plan view taken on the line 10,10 of FIG. 9.

Turning now to FIGS. 9 and 10, it can be seen that the general construction of the chamber 39 as defined by the inside of the outer cabinet 11 and end walls 41 and 41*a*, so that the only exit for air is through filter 43. The upper vanes 19*a* and 19*b* are shorter as the device has less depth than width, as illustrated by comparison of these distances in FIGS. 6 and 9. This tends to send more of the purified air out directly over the user at the workspace, because there is that much less resistance to overcome. However, there is enough distance for air flow to become laminar to achieve the quiet and gentleness as previously described.

In order to test the efficacy of the present invention, a number of tests were performed on the device shown in the drawings. Measurements of particle count were made at various places in rooms where the device had been installed. It was found that the present invention does provide an umbrella of fresh air at the workspace. In one room where there were 600,000 particles per cubic foot in a room, 98% of the particles were removed from the air discharged by the present invention directly at the workspace and within one meter of the exhaust vanes. In another office where the particle count was 300,000 per cubic foot at a distance of about three meters from the device of this invention, the particle count within the umbrella of air was 2500 per cubic foot, less than one percent (1%) of the count about 3 meters away.

While particular embodiments of the present invention have been illustrated and described, it is not intended to limit the invention, except as defined by the following claims.

We claim:

1. A device for use with at least one workspace, comprising:

a chamber including an outer wall and end walls forming the chamber;

filter means defining an inner wall of said chamber and being the sole outlet of air entering said chamber;

a fan motor mounted inside said filter means and including a drive shaft extending axially out from motor in two directions;

an intake fan mounted on one end of the shaft, including first path defining means for defining a sealed path which is the sole air inlet to said chamber;

an exhaust fan mounted on the other end of shaft, including second path defining means for defining a path from said sole outlet to said exhaust fan for exhausting air in a generally axial direction; and baffle means for deflecting air in said axial direction to a radial direction while reducing the velocity of said air to laminar flow.

2. The device of claim 1, wherein said baffle means include an upper terminal lid of the chamber and a plurality of annular stepped vanes for dividing axially exhausted air into turbulent air streams and converting said turbulent air streams into radial laminar flow.

3. The device of claim 2, wherein said plurality of stepped vanes comprises two annular stepped vanes spaced axially in from said lid and having decreasing inner radii in the direction from said exhaust fan to said lid.

4. The device of claim 1, wherein said motor is rated at less than 2 amp and said device produces at least 150 CFM of exhaust air.

5. The device of claim 1, wherein said filter is a HEPA filter requiring about 150 CFM for optimum filtration efficiency.

6. The device of claim 1, which further includes means for mounting said device on a divider wall of a work station.

7. The device of claim 1, wherein said first path defining means includes seal means for preventing air flow to said shaft.

8. A device for use with at least one workspace, comprising:

a chamber including an outer wall and end walls forming the chamber;

HEPA filter means requiring about 150 CFM for optimum filtration efficiency and defining an inner wall of said chamber and being the sole outlet of air entering said chamber;

a fan motor mounted inside said inner wall of the chamber and including a drive shaft extending axially out from motor in two directions, said motor being rated at less than 2 amp and producing at least 150 CFM of exhaust air;

an intake fan mounted on one end of the shaft, including first path defining means for defining a sealed path which is the sole air inlet to said chamber including seal means for preventing air flow to said shaft;

an exhaust fan mounted on the other end of shaft, including second path defining means for defining a path from said sole outlet to said exhaust fan for exhausting air in an axial direction; and baffle means for deflecting air in said axial direction to a radial direction while reducing the velocity of said air to laminar flow comprising an upper terminal lid and a plurality of annular stepped vanes for dividing axially exhausted air into turbulent air streams and converting said turbulent air streams into radial laminar flow to thereby produce noise proximate thereto of less than 47 decibels in an umbrella of clean room air for a distance of at least one meter from said device and having 98% fewer particles than the air in the area at least three meters from said device.

9. The device of claim 8, wherein said plurality of vanes comprises two annular stepped vanes spaced axially out from said exhaust fan and having decreasing inner radii in the direction from said exhaust fan to said lid.

10. The device of claim 8, wherein said device further includes means for mounting said device on a divider wall of a work station.

11. A method of providing an umbrella of clean room air in at least one workspace for a distance of at least one meter within said workspace and having 98% fewer particles than the air in the area at least three meters from said workspace, comprising the steps of:

providing a chamber proximate a workspace, said chamber having an outer wall, end walls and an inner wall defined by filter means to form a sealed chamber in which said filter means is the sole outlet of air entering said chamber; said air being drawn into said chamber by a fan motor mounted proximate the center of the filter means and including a drive shaft extending axially out from motor in two directions;

drawing air into said chamber using an intake fan mounted on one end of the shaft along a first path defining means for defining a sealed path which is the sole air inlet to said chamber;

exhausting air in an axial direction using an exhaust fan mounted on the other end of shaft, by defining a second path from said sole outlet to said exhaust fan; and deflecting air in said axial direction to a radial direction with baffle means including an upper terminal lid for said device and a plurality of annular stepped vanes to divide axially exhausted air into turbulent air streams and convert said turbulent air streams into radial laminar flow with reduced velocity of deflected air to have laminar flow.

12. The method of claim 11, including the step of dividing said exhaust air with two annular stepped vanes spaced axially out from said exhaust fan and having decreasing inner radii in the direction from said exhaust fan to said lid.

13. The method of claim 11, wherein said motor is rated at less than 2 amp and produces at least 150 CFM of exhaust air, said filter is a HEPA filter requiring about 150 CFM for optimum filtration efficiency, and said device produces noise proximate thereto of less than 47 decibels.

14. The method of claim 11, which further includes the step of mounting said device on a divider wall of a work station.

* * * * *